United States Patent [19]

Richings

[11] 4,174,556

[45] Nov. 20, 1979

[54] CASKET

[76] Inventor: Richard R. Richings, E. 1707 Bismark, Spokane, Wash. 99207

[21] Appl. No.: 852,110

[22] Filed: Nov. 16, 1977

[51] Int. Cl.[2] ..... A61G 17/00

[52] U.S. Cl. ..... 27/7

[58] Field of Search ..... 27/2, 7, 35, 19

[56] References Cited

U.S. PATENT DOCUMENTS

| | | | |
|---|---|---|---|
| 1,260,927 | 3/1918 | McKinney | 27/7 |
| 2,848,780 | 8/1958 | Gosnell | 27/7 |
| 2,940,156 | 6/1960 | Cook | 27/7 X |
| 3,487,513 | 1/1970 | Herring et al. | 27/19 |
| 3,868,799 | 3/1975 | Hayward | 27/2 X |
| 3,879,818 | 4/1975 | Rowland | 27/7 |
| 3,918,133 | 11/1975 | Schmitz | 27/2 |
| 4,044,435 | 8/1977 | Acton | 27/2 |

*Primary Examiner*—John D. Yasko

*Attorney, Agent, or Firm*—Wells, St. John & Roberts

[57] ABSTRACT

A casket is disclosed that is constructed of synthetic resin material. The casket includes a removable top cover that selectively encloses a body supporting bed. The bed includes an integral pillow recess and a body supporting pad recess. The bed is affixed to a base that provides rigidity to the bed construction and facilitates handling of the casket. The base includes longitudinal skids that are designed to rest against a support surface. Peripheral fingerhold is provided at the casket periphery. The skids elevationally locate the fingerhold above any flat support surface to further facilitate handling of the casket. A ledge extends about the bed to receive a lower peripheral edge of the top cover. A rim extends above and outwardly of the ledge to form a cleft between the cover and bed. This cleft extends about the bed and can be filled with a sealing compound in order to bond the bed and cover together and to provide a hermetic seal, protecting the contents of the casket. Reinforcement is provided about the base and bed to impart rigidity to the entire unit and to evenly distribute the weight of a body supported thereby.

12 Claims, 8 Drawing Figures

FIG. 1
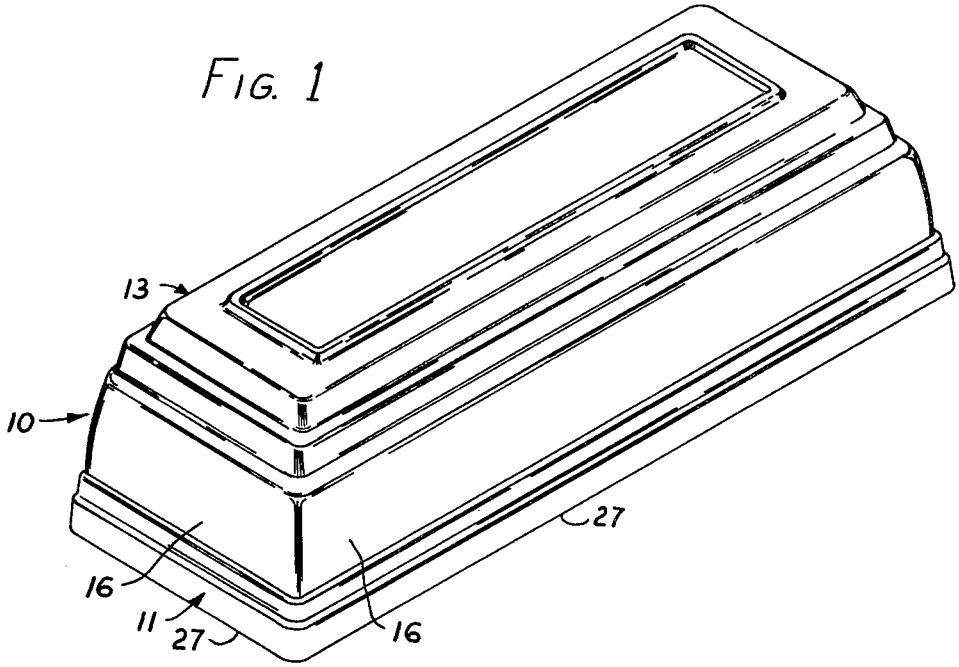
FIG. 2
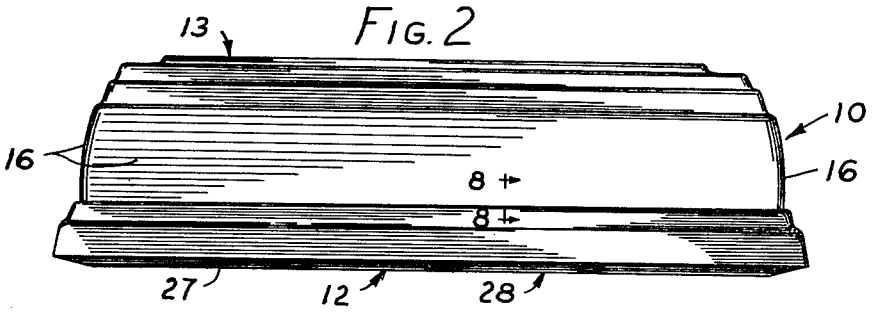
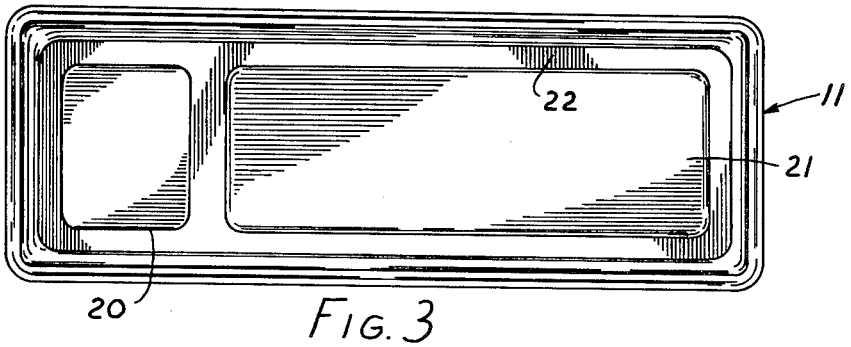
FIG. 3
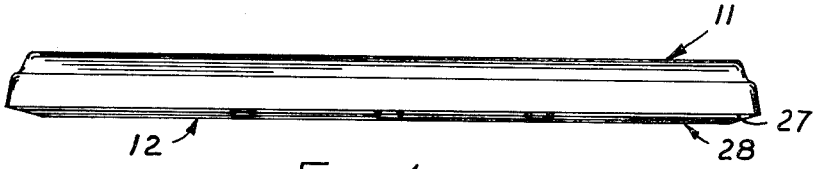
FIG. 4

FIG. 5
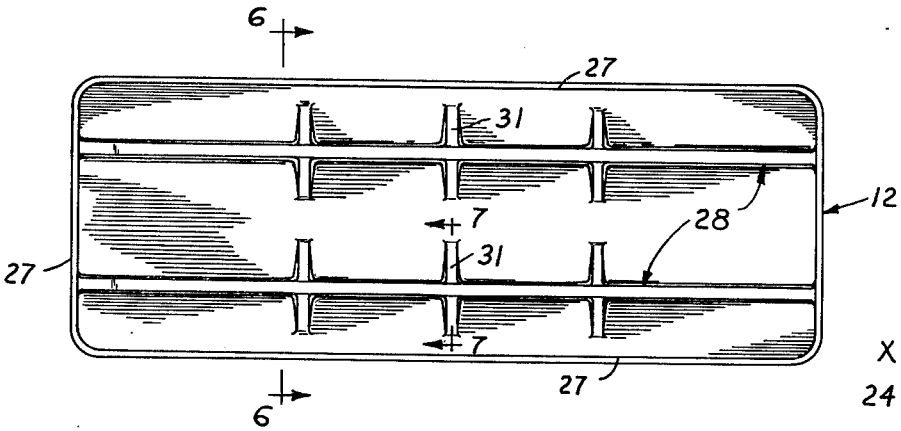
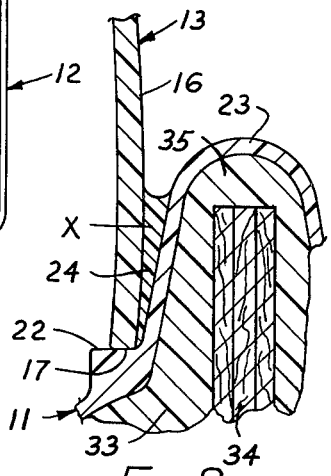
FIG. 8
FIG. 6
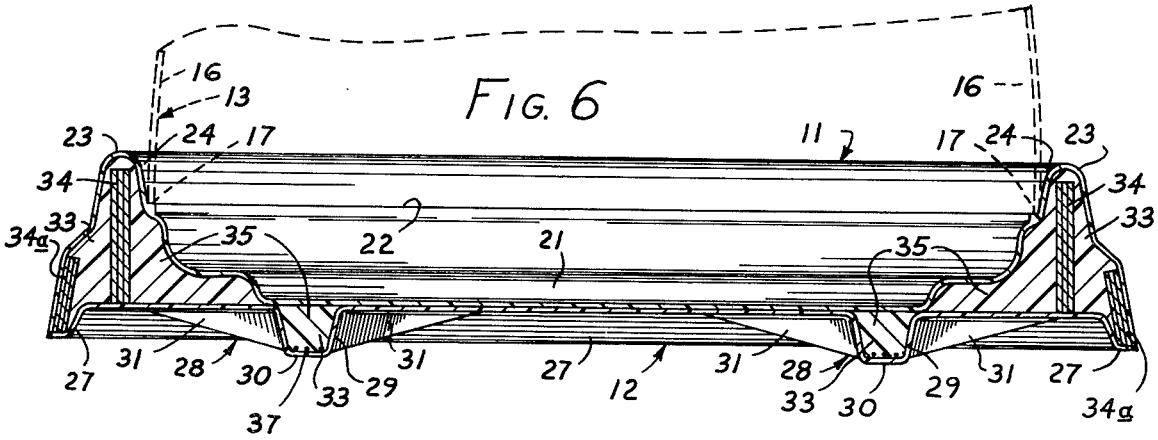
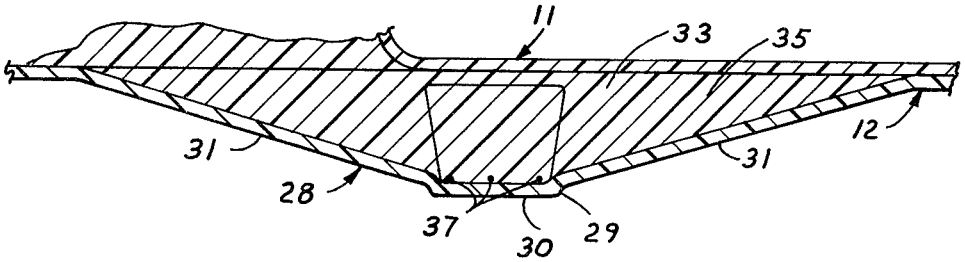
FIG. 7

CASKET

BACKGROUND OF THE INVENTION

It has long been desired to obtain a casket design that is both practical, aesthetically appealing and yet inexpensive. This has long been a frustrated goal since the nature of the design and the construction materials require a substantial amount of skilled labor. Further, the typical casket, either wood or metal construction, cannot be effectively sealed for extremely long periods of time.

The above problems have been partially eliminated by R. W. Gosnell whose U.S. Pat. No. 2,848,780 discloses a vault and casket combination that is constructed entirely of fiberglass material. This casket is still of rather complex design, utilizing several corrugated layers for supporting thin plastic cover sheets. Gosnell uses a peripheral sealing concept that is effective in hermetically sealing the casket contents. This is done by placing a bead of bonding agent or sealing compound within a peripheral groove of the body support platform. This groove is complementary to the lower edge of the casket cover. When the cover is received within the groove, the sealing agent bonds the two units into a single intergral unit. The body support surface is formed of a corrugated fiberglass material which must be covered to present an appropriate appearance. Also, the base is planar in configuration so it will lie flat on a planar support surface with no integral provision for gripping and lifting the casket. This must therefore be done with the aid of extrinsic tools.

The present invention was designed with its primary object being to provide a lightweight, strong, and inexpensive casket formed or molded of a synthetic resin material such as fiberglass reinforced synthetic resin and thermoplastic sheet material.

Another primary object is to provide such a casket that may be effectively hermetically sealed and wherein the sealed condition will last considerably longer than prior forms of metal and wooden casket construction.

A further object is to provide such a casket that includes integral fingerhold areas that are supported above any flat support surface whereby attendants may easily lift and handle the casket.

A still further object is to provide such a casket that includes integral recesses within a bed portion for receiving a body supporting pad and pillow.

These and still further objects and advantages will become apparent upon reading the following description which, taken with the accompanying drawings, describe a preferred form of my invention. It should be noted however that the description and drawings are merely presented to describe a preferred form of the invention and that various other forms may be readily envisioned. Therefore only the claims found at the end of the specification are to be taken as strict definitions and limitations upon the scope of my invention.

BRIEF DESCRIPTION OF THE DRAWINGS

A preferred form of the present invention is illustrated in the accompanying drawings in which:

FIG. 1 is a pictorial view of the present casket;

FIG. 2 is a side elevation view of the casket;

FIG. 3 is a top plan view of the bed portion of the casket;

FIG. 4 is a side elevational view of the bed portion shown in FIG. 3;

FIG. 5 is a bottom plan view of the base portion;

FIG. 6 is an enlarged transverse sectional view taken along line 6—6 in FIG. 5;

FIG. 7 is an enlarged fragmentary section taken along line 7—7 in FIG. 5; and

FIG. 8 is an enlarged fragmentary sectional view taken along line 8—8 in FIG. 2.

DETAILED DESCRIPTION OF A PREFERRED EMBODIMENT

The present invention is shown in FIG. 1 embodied in a casket formed of synthetic resin material. The casket is indicated generally by the reference character 10. Basically, the casket 10 is comprised of three interrelated parts. It includes a bed 11 (as shown in FIGS. 3 and 6), a base 12 that is affixed to and is substantially integral with the bed (shown in FIGS. 5 and 6), and a top cover 13 (FIGS. 1 and 2). The top cover 13 may vary in design to produce an aesthetic outward appearance. However, regardless of design, the cover will include substantially upright sides 16 and a downwardly facing peripheral edge 17 (as shown in detail by FIG. 8).

The bed 11 may be formed by processes similar to that utilized in forming the top cover 13. Bed 11 includes integral recesses for receiving and positioning a pillow and body support pad (not shown). The integral pillow recess is shown at 20 and is located at a forward end of the bed. The integral body supporting pad recess is shown at 21 and is longitudinally spaced from the pillow recess 20 and extends to a foot end of bed 11. The recesses 20 and 21 are encircled by a peripheral ledge 22 (FIGS. 3 and 6) that receives and fits flush against the peripheral edge 17 of top cover 13. A raised rim 23 also extends about the bed 11. The rim 23 is spaced slightly outward of the ledge 22. The raised rim 23 and sides 16 define a peripheral cleft 24 as shown in FIGS. 6 and 8 which is intended to receive a sealing agent X for the purpose of bonding the cover and bed together and for hermetically sealing the area enclosed thereby. Preferably, the sealing agent X utilized will be of a type that will partially dissolve and become integral with the material of the cover and bed. Where fiberglass material is utilized, the sealing agent X may be a synthetic material which will be applied into the cleft 24 and, when cured, becomes integral with the cover and bed.

As briefly discussed above, the base 12 is initially formed as a third component of the casket unit but is affixed to the bed by means of adhesive or other appropriate fastening means (not shown) in such a manner as to make the bed and base an integral unit. The base 12 is designed to provide a substantial amount of rigidity both longitudinally and transversely to the bed, and to provide support. Base 12 includes a peripheral fingerhold 27 that extends about the base and bed to facilitate gripping and handling of the casket. This fingerhold 27 is supported elevationally above any planar support surface by a support means 28. Support means 28 includes a pair of longitudinal skids 29. The skids 29 extend the full length of the base 12 and are spaced apart laterally at strategic locations to evenly distribute the weight of a body within the casket along the length thereof. The skids 29 include bottom skid surfaces 30 that enable the casket to be slid relatively effortlessly in any longitudinal direction. It is preferred that the elevational distance between the skid surfaces 30 and the fingerhold 27 is approximately one half inch. Thus, when the casket is supported on a flat surface, the fingerhold 27 is located one half inch above the initial support surface to enable access for a handler's fingers and thereby provide a solid and sure grip.

The support means 28 further includes a number of transverse gussets 31. Six such gussets 31 are shown in FIG. 5 and one is shown in detail by the enlarged sectional detail of FIG. 7. The gussets 31 are strategically located along the length of the skids 29 to aid in distribution of the body weight resting on the bed 11 across the base 12. The gussets 31 extend transversely from skids 29 and are formed integrally with the skids and remainder of the base 12.

As may be seen from FIGS. 6 and 7, the bed 11 and base 12 are not complementary in configuration. Therefore, several void areas 33 are formed between the two. These areas are utilized for reinforcing purposes. Specifically, the area outwardly adjacent to the peripheral ledge 22 receives at least one substantially continuous reinforcing member 34. Another member **34*a* may be provided directly upward of the finger hold 27. These members 34 and 34*a* impart substantial longitudinal and transverse rigidity to the joined base and bed members to facilitate handling at the fingerhold areas. The reinforcing members are held in place within the voids 33 by a support fill material 35**. Such material may be expanded syntactic, structural or other synthetic resinous foam or expanded or extended material. The foam itself adds an element of structural stability to the bed and base members by forcing the members to retain their molded configuration.

As may be noted, the foam fill 35 is also provided with the voids formed within skids 29 and gussets 31. Additional reinforcement may be provided at 37 within the skids 29 adjacent skid surfaces 30. This reinforcement may be in the form of glass strands or cables imbedded within the material of base 12, or it may be provided by longitudinal members similar to members 34 and **34*a*. FIG. 7 also shows the gussets 31 to be filled with the foamed material 35**. Again, the fill in this area enhances the support feature provided by the gussets. If desired, additional reinforcement may be provided in this area also.

In readying the casket for use, a pillow is placed within the pillow receiving recess 20 and a thin resilient pad is similarly located within the pad recess 21. The corpse is then laid on this support surface and is covered with the top cover 13. The peripheral edge 17 of cover 13 thus comes into flush contact with the peripheral ledge 22 of bed 11. The cleft 24 created between the cover sides 16 and raised rim 23 of bed 11 may then be filled with a sealant. In doing so, the entire area enclosed by the cover is hermetically sealed. The casket is then ready for conventional burial practices. During internment, the seal will remain effective for as long as the remainder of the casket is intact. This is so since the sealant material bonds with the material of the cover and base to form the two previously separate components into a single sealed unit.

As discussed above, it may become apparent from the drawings and description that various changes and modifications can be made therein. Modifications are presently contemplated but, for the sake of brevity, have been omitted from this description. Therefore, only the following claims are to be taken as distinct limitations upon the scope of my invention.

What I claim is:

1. A casket comprising:

a base molded of synthetic resin;

said base having integral casket support means formed therein;

a bed molded of synthetic resin mounted on and bonded to the base and having a central portion supported above the base;

said central portion of the bed having recesses formed in the central portion of the bed and extending downward engaging the base for receiving a pillow and having a body supporting pad;

a removable top cover for enclosing a portion of the bed including the integral recesses;

said top cover having a bottom peripheral edge for resting against the bed;

said bed having a continuous peripheral ledge for receiving the peripheral edge of the top cover and for supporting the top cover; and said bed having a raised rim located outwardly and upward of the ledge for forming an exposed peripheral cleft between the bed and top cover when the top cover is in place on the bed, said cleft being adapted to be filled with a sealing agent to bind the bed and top cover together and to hermetically seal the casket.

2. The casket as defined by claim 1 wherein the base includes an integral peripheral fingerhold and wherein the support means is designed to support the peripheral fingerhold at a selected elevation above any flat support surface.

3. The casket as defined by claim 1 wherein the support means is comprised of a laterally spaced pair of longitudinal skids extending the length of the base and integral therewith.

4. The casket as defined by claim 3 wherein the support means further includes a plurality of integrally molded gussets extending transversely from the skids and located at selected longitudinal positions thereon to provide maximum support for body weight.

5. A casket comprising:

a base molded of synthetic resin;

a bed molded of synthetic resin mounted on and bonded to the base;

said base having integral casket support means formed therein;

a removable top cover for enclosing a portion of the bed including the integral recesses;

said top cover having a bottom peripheral edge for resting against the bed;

wherein said bed includes a peripheral ledge for receiving the peripheral edge of the top cover and for supporting the top cover; and elongated reinforcing members extending along the perpheral ledge between the base and bed for imparting substantial longitudinal and transverse rigidity to the bonded base and bed;

said bed having a raised rim extending outwardly and upward of the ledge for forming an exposed peripheral cleft between the bed and top cover when the top cover is in place on the bed, said cleft being adapted to be filled with a sealing agent to bind the bed and top cover together and to hermetically seal the casket.

6. The casket as defined by claim 5 wherein the base includes an integral peripheral fingerhold adjacent the reinforcing members and wherein the support means is designed to support the peripheral fingerhold at a selected elevation above any flat support surface.

7. The casket as defined by claim 5 wherein voids are formed between the rim of the bed and base and wherein such voids are filled with an expanded synthetic resin material.

8. The casket as defined in claim 7 wherein the reinforcing members are mounted in the voids.

9. A casket comprising:

a base molded of synthetic resin;

a bed molded of synthetic resin mounted on and bonded to the base and having a central portion with depending recesses for receiving a pillow and a body supporting pad;

said base having integral casket support means formed therein;

a removable top cover for enclosing a portion of the bed including the integral recesses;

said top cover having a bottom peripheral edge for resting against the bed;

said bed includes a raised continuous peripheral ledge elevated above the central portion of the bed for receiving the peripheral edge of the top cover above the recesses and for supporting the top cover; and the bed has a rim located outwardly and upward of the ledge for forming an exposed peripheral cleft between the bed and top cover when the top cover is in place on the bed with the peripheral edge of the top cover engaging the raised ledge, said cleft being adapted to be filled with a sealing agent to bind the bed and top cover together and to hermetically seal the area enclosed thereby.

10. The casket as defined by claim 9 wherein the base includes an integral peripheral fingerhold and wherein the support means is designed to support the peripheral fingerhold at a selected elevation above any flat support surface.

11. The casket as defined by claim 9 wherein the support means is comprised of a laterally spaced pair of longitudinal skids extending the length of the base and integral therewith.

12. The casket as defined by claim 11 wherein the support means further includes a plurality of integrally molded gussets extending transversely from the skids and located at selected longitudinal positions thereon to provide maximum support for body weight.

* * * * *